United States Patent [19]

Anderson

[11] Patent Number: 4,700,124

[45] Date of Patent: Oct. 13, 1987

[54] CURRENT AND FREQUENCY CONTROLLED VOLTAGE REGULATOR

[75] Inventor: Floyd E. Anderson, Phoenix, Ariz.

[73] Assignee: Motorola, Inc., Schaumburg, Ill.

[21] Appl. No.: 944,107

[22] Filed: Dec. 22, 1986

[51] Int. Cl.[4] ..... G05F 1/613

[52] U.S. Cl. ..... 323/225; 323/350; 323/351

[58] Field of Search ..... 323/223, 225, 349, 350, 323/351

[56] References Cited

U.S. PATENT DOCUMENTS 4,374,357 2/1983 Olesin et al. ..... 323/351

*Primary Examiner*—Patrick R. Salce

*Assistant Examiner*—Jeffrey Sterratt

*Attorney, Agent, or Firm*—John A. Fisher; Jeffrey Van Myers; Robert L. King

[57] ABSTRACT

A voltage regulator circuit which provides a regulated output voltage by regulating output current at an output terminal is provided. The voltage regulator circuit operates in response to a clocked control signal. The regulated output voltage and a delayed signal of the regulated output voltage are both used to bias a selected one of series-connected transistors which sink current from the output terminal in response to the value of the output voltage and the frequency of the clocked control signal. A second control signal is provided for enabling or disabling the voltage regulator circuit.

7 Claims, 2 Drawing Figures

CURRENT AND FREQUENCY CONTROLLED VOLTAGE REGULATOR

TECHNICAL FIELD

This invention relates generally to voltage regulator circuits, and more particularly, to voltage regulators responsive to current and frequency changes.

BACKGROUND ART

Circuits are frequently required to provide a constant regulated voltage which is derived from a coupled power supply. The regulated voltage is typically provided as a voltage having a value translated from the power supply voltage and may be derived via a resistive or diode voltage divider. A problem typically encountered when deriving a voltage from a power supply is that the power supply voltage will vary as a function of temperature and processing variables causing the derived voltage to also vary. After translating a voltage from a power supply, others have used voltage regulators to regulate the translated voltage. Known voltage regulators typically use operational amplifiers or other circuitry which increase the size of the overall circuit by a significant amount. The additional circuitry may also require resistive or capacitive elements external to the circuit in integrated form. Therefore, additional leads associated with an integrated circuit package used to fabricate the circuit may be required to provide voltage regulation.

BRIEF DESCRIPTION OF THE INVENTION

Accordingly, an object of the present invention is to provide an improved voltage regulator circuit.

Another object of the present invention is to provide an improved current and frequency controlled voltage regulator circuit.

A further object of the present invention is to provide an improved voltage regulator circuit which minimizes circuitry.

In carrying out the above and other objects of the present invention, there is provided, in one form, a voltage regulator circuit for providing a regulated output voltage at an output terminal and having a predetermined value. Input logic is coupled to the output terminal for providing an output current limit signal in response to both a first control signal and the voltage. A delay portion is coupled to both the output terminal and the input logic for providing a delayed output current limit signal. An output portion is coupled to the output terminal, to the input logic and to the delay portion. The output portion selectively sinks current from the output terminal in response to both the output current limit signal and the delayed output current limit signal to provide the regulated output voltage.

These and other objects, features and advantages will be more clearly understood from the following detailed description taken in conjunction with the accompanying drawings.

DETAILED DESCRIPTION OF THE INVENTION

Figure 1:
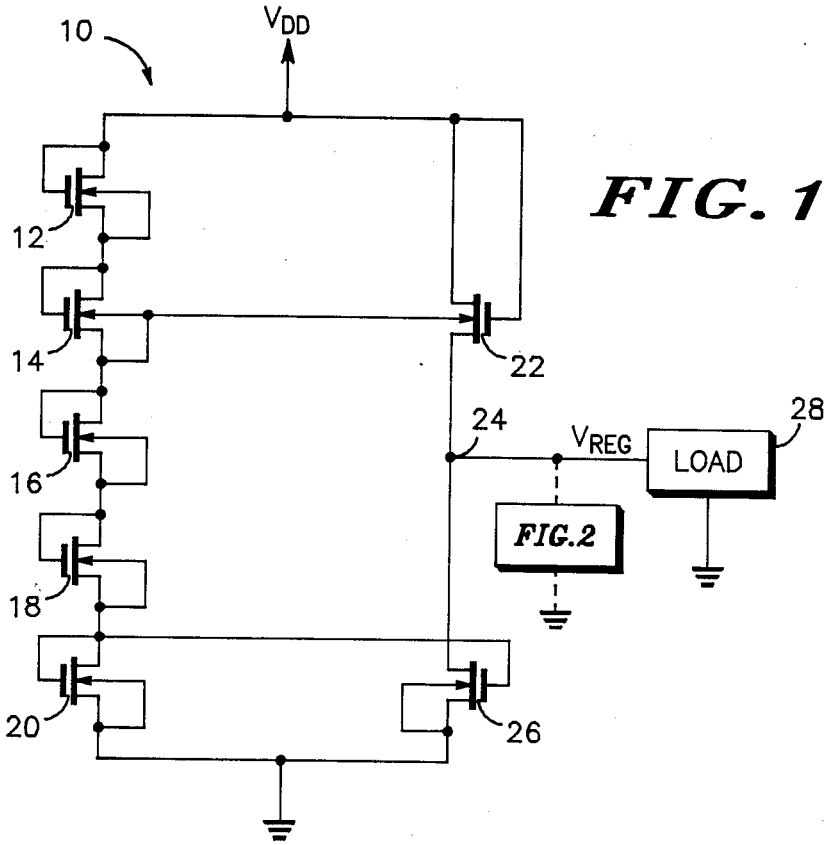
FIG. 1 illustrates in schematic diagram form, a circuit for deriving a voltage from a power supply.

Shown in FIG. 1 is a circuit 10 for providing a translated voltage, labeled $V_{REG}$, which is derived from a power supply voltage labeled $V_{DD}$. A plurality of diode-configured N-channel transistors 12, 14, 16, 18 and 20 is connected in series between power supply voltage $V_{DD}$ and a ground reference potential. Transistor 12 has both a source and a gate connected together to power supply voltage $V_{DD}$. A drain of transistor 12 is connected to a substrate of transistor 12 and to a source of transistor 14. The source of transistor 14 is also connected to a gate of transistor 14. A substrate of transistor 14 is connected to a drain thereof and connected to both a connected source and gate of transistor 16. A drain of transistor 16 is connected to a substrate thereof and to both a connected source and gate of transistor 18. A drain of transistor 18 is connected to a substrate thereof and to both a connected source and gate of transistor 18. A drain of transistor 18 is connected to a substrate thereof. The drain of transistor 18 is also connected to both a source and a gate of transistor 20. A drain of transistor 20 is connected to both a substrate thereof and to the ground reference voltage. A source of transistor 12 is connected to a gate of an N-channel transistor 22 and connected to power supply voltage $V_{DD}$. A substrate of transistor 22 is connected to the substrate of transistor 14 indicating that the substrates of transistors 14 and 22 are formed in the same P-well during fabrication. A drain of transistor 22 is connected to an output terminal 24 to provide a regulated output voltage labeled $V_{REG}$. A source of an N-channel transistor 26 is also connected to output terminal 24, and a gate of transistor 26 is connected to both the gate and source of transistor 20. A drain of transistor 26 is connected to the ground reference potential. The substrate of transistor 26 is also connected to the ground reference potential, and transistors 20 and 26 are formed in the same P-well during fabrication. A load 28 has a first terminal connected to output terminal 24 and a second terminal connected to the ground reference voltage. A voltage regulator circuit illustrated in FIG. 2 may also be coupled to output terminal 24 as shown by the dashed line and explained below.

In operation, circuit 10 functions to provide output voltage $V_{REG}$ which has a voltage value translated from supply voltage $V_{DD}$. In a preferred form, transistors 12, 14, 16, 18 and 20 are fabricated as equal sized transistors so that the voltage potential between ground and $V_{DD}$ is substantially equally distributed across each of the series-connected transistors. Transistor 26 is size ratioed to have the same gate dimensions as transistors 12, 14, 16, 18 and 20, and transistor 22 is size ratioed a predetermined amount in relation to all other transistors depending upon the amount of output current and voltage desired. By fabricating transistors 14 and 22 in the same P-tub, transistors 14 and 22 have the same threshold voltage. Similarly, transistors 20 and 26 have the same threshold voltage since both transistors are fabricated in the same P-tub. By size ratioing the transistors of circuit 10 in a conventional manner, a predetermined translated output voltage may be provided at output terminal 24. The load 28 is connected to output terminal 24 for receiving the output voltage $V_{REG}$. However, in the operation of circuit 10 discussed up to this point, output voltage $V_{REG}$ of circuit 10 may vary significantly if supply voltage $V_{DD}$ is not an accurate reference voltage. The present invention provides an efficient voltage regulator circuit which may be coupled to output terminal 24 of circuit 10 to provide a regulated output voltage.

Figure 2:
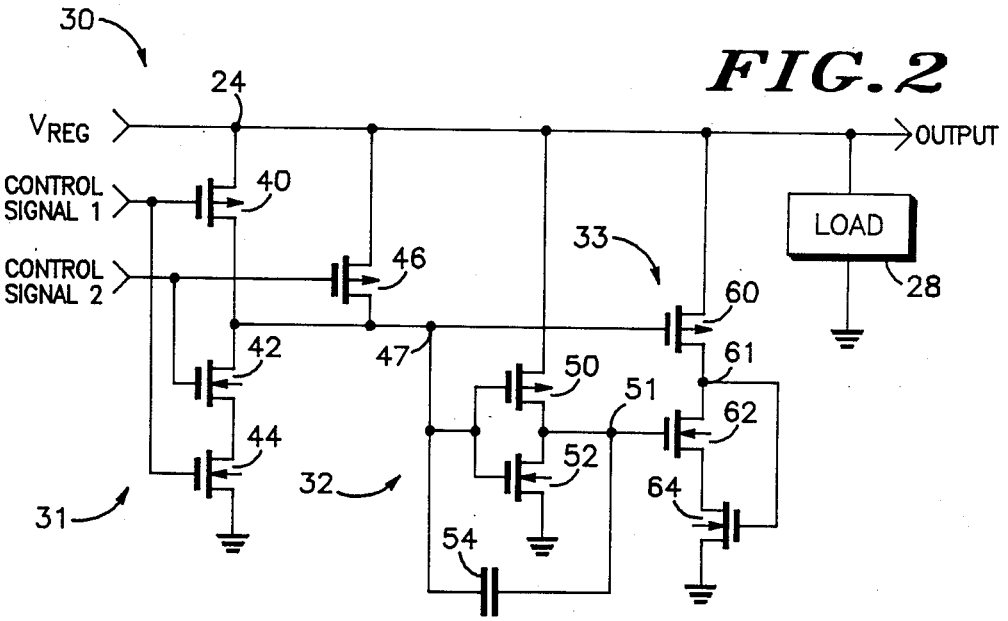
FIG. 2 illustrates in schematic form a voltage regulator circuit in accordance with the present invention for use with the circuit of FIG. 1.

Shown in FIG. 2 is a voltage regulator 30 in accordance with the present invention for use with circuit 10 of FIG. 1. Generally, voltage regulator 30 comprises an input logic portion 31, a delay control portion 32 and an output portion 33. While specific N-channel and P-channel MOS devices are shown, it should be clear that regulator 30 could be implemented by completely reversing the processing techniques (e.g. P-channel to N-channel) or by using other types of transistors.

In input logic portion 31, a P-channel transistor 40 has a drain connected to output voltage $V_{REG}$ at output terminal 24 of FIG. 1. To more clearly illustrate how voltage regulator 30 may be used with circuit 10, elements common to both circuits will retain the same number in both FIGS. 1 and 2. A first control signal labeled "Control Signal 1" is coupled to a gate of transistor 40. A source of transistor 40 is connected to a drain of an N-channel transistor 42. A gate of transistor 42 is coupled to a second control signal labeled "Control Signal 2", and a drain of transistor 42 is connected to a source of an N-channel transistor 44. A gate of transistor 44 is connected to the first control signal, and a drain of transistor 44 is connected to a ground reference potential. A P-channel transistor 46 has a drain connected to output voltage $V_{REG}$, a gate connected to the second control signal, and a source connected to the drain of transistor 42 at a node 47. Node 47 functions as an output of input logic portion 31.

In delay control portion 32, a P-channel transistor 50 has a drain connected to output terminal 24, and has a gate connected to both a gate of an N-channel transistor 52 and a first electrode of a capacitor 54 at node 47. A source of transistor 50 is connected to both a node 51 and a source of transistor 52. A drain of transistor 52 is connected to the ground reference potential. A second electrode of capacitor 54 is connected to node 51.

In output portion 33, a P-channel transistor 60 has a drain connected to output terminal 24. A gate of transistor 60 is connected to node 47, and a source of transistor 60 is connected to node 61. A source of an N-channel transistor 62 is connected to node 61, and a gate of transistor 62 is connected to node 51. A drain of transistor 62 is connected to a source of an N-channel transistor 64. Transistor 64 has a gate connected to node 61 and a drain connected to the ground reference potential. Load 28 of FIG. 1 remains connected between output terminal 24 and the ground reference potential as shown in FIG. 2. A regulated output voltage labeled "Output" is provided at node 24.

In operation, control signal 2 is an on/off control signal which enables or disables voltage regulator 30. When control signal 2 is at a logic low level, transistor 46 is conductive which couples output voltage $V_{REG}$ to the gate of transistor 60 thereby making transistor 60 nonconductive. Simultaneously, transistor 42 is made nonconductive by control signal 2. Therefore, voltage regulator 30 is effectively disconnected from output terminal 24. When control signal 2 is at a logic high level, transistor 46 is nonconductive and transistor 42 is conductive thereby placing voltage regulator 30 in an operating mode.

For the purpose of illustration only, assume that control signal 1 is an oscillating square wave clock signal. When control signal 1 is at a logic high level, transistor 40 is nonconductive but transistors 50 and 60 will be conductive. Transistor 50 couples the output voltage $V_{REG}$ to the gate of transistor 62 at node 51 which makes transistor 62 conductive. When transistor 60 is conductive, transistor 64 becomes conductive since transistor 60 couples output voltage $V_{REG}$ to the gate of transistor 64. Therefore, transistors 60, 62 and 64 are conductive and sinking a predetermined amount of current from output terminal 24 to the ground potential. In the illustrated form, input logic portion 31 is functionally equivalent to a two-input NAND gate wherein control signals 1 and 2 define the two inputs and node 47 defines the output. Transistor 44 functions to prevent a current sink path between output terminal 24 and ground potential via transistors 40 and 42. Assume for the purpose of illustration only that supply voltage $V_{DD}$ is five volts but may vary between approximately 4.5 volts and 5.5 volts. Transistors 60, 62 and 64 selectively sink a varying amount of current from output terminal 24 to maintain $V_{REG}$ at a predetermined value, such as 3.5 volts, as $V_{DD}$ varies. The gates of transistors 60, 62 and 64 are size ratioed with each other for the purpose of controlling, in part, the amount of current sunk from output terminal 24 to the ground potential thru transistors 60, 62 and 64. In particular, transistor 60 is ratioed larger than transistors 62 and 64 so that the maximum amount of current sunk from output terminal 24 is determined by the conductance of transistor 60. Transistors 62 and 64 are sized smaller than transistor 60 and in a preferred form have substantially equal sized gate dimensions. Therefore, the minimum current sunk by transistors 60, 62 and 64 is limited by the conductance of transistor 64 which is controlled by the voltage derived at node 61. The amount of current sunk by transistors 60, 62 and 64 is also determined by the amount of bias voltage applied to the gate of transistor 60 via transistor 40 which is directly proportional to the amount of variation of $V_{REG}$ caused by $V_{DD}$ varying. In this way, voltage $V_{REG}$ is regulated at output terminal 24 by regulating the current at terminal 24 in proportion to variations in $V_{DD}$. As control signal 1 oscillates at a slow frequency, transistor 60 is successively turned on and off so that current is not constantly sunk from output terminal 24. Control signal 1 need only oscillate at a frequency sufficient to allow current to be sunk from output terminal 24 frequently enough to react to changes in $V_{REG}$ and maintain a constant valued output voltage $V_{REG}$.

Delay portion 32 also functions in a feedback mechanism to regulate $V_{REG}$ in response to the frequency of control signal 1. As the frequency of control signal 1 increases, the amount of current sunk by transistors 60, 62 and 64 inherently tends to increase because transistors 60, 62 and 64 are more conductive. Therefore, the present invention also regulates the output voltage as a function of frequency in addition to regulating the output current. As previously mentioned, control signal 1 is typically a square wave clock signal. When control signal 1 operates at a high frequency, such as in the range of 10–20 MHz, the current at output terminal 24 is no longer regulated by transistors 60, 62 and 64. At a high clock rate, control signal 1 is not able to make transistor 62 conductive during the time period when transistor 60 is conductive. The loss of synchronization in simultaneous conduction of transistors 60 and 64 is controlled by delay portion 32. At high clock frequencies, control signal 1 is delayed by transistors 50 and 52 and capacitor 54. The actual amount of delay which needs to be provided by delay portion 32 for a predetermined high frequency range may be fixed by size ratioing the gate sizes of transistors 50 and 52. In this manner the threshold voltages of transistors 50 and 52 are adjusted to provide a fixed amount of delay between node 47 and node 51 at a predetermined high frequency. Variations in $V_{REG}$ are fed back thru transistor 40 to the gates of transistors 50 and 52 of delay portion 32 and to the gate of transistor 60 and may cause $V_{REG}$ to be regulated by transistors 60, 62 and 64 even at high frequency if $V_{REG}$ begins to deviate from a predetermined value by a significant amount. Capacitor 54 may be small valued so that capacitor 54 may be fabricated internal to an integrated circuit without sacrificing a large amount of circuit area.

By now it should be apparent that a voltage regulator which regulates by controlling output current and in response to the frequency of operation of a control signal has been provided. The present invention is implemented with a small amount of circuitry and requires no components external to an integrated circuit package. The voltage regulator taught herein is capable of accurately regulating an output voltage which has been translated from a varying power supply. Since a constant current path does not exist between the regulated voltage and a ground potential, power dissipation is also minimized.

While the invention has been described in the context of a preferred embodiment, it will be apparent to those skilled in the art that the present invention may be modified in numerous ways and may assume many embodiments other than that specifically set out and described above. Accordingly, it is intended by the appended claims to cover all modifications of the invention which fall within the true spirit and scope of the invention.

I claim:

1. A voltage regulator circuit for regulating a voltage provided at an output terminal to maintain a predetermined value comprising:

input logic means coupled to the output terminal for providing an output current limit signal in response to both a first control signal and the voltage;

delay means coupled to both the output terminal and the input logic means, for providing a delayed output current limit signal, said delay being related to frequency of the first control signal; and output means coupled to the output terminal, to the input logic means and to the delay means, for selectively sinking current from the output terminal in response to both the output current limit signal and the delayed output current limit signal to provide a regulated output voltage.

2. The voltage regulator of claim 1 wherein said input logic means further comprise:

a first transistor of a first conductivity type having a first current electrode coupled to the output terminal, a control electrode coupled to the first control signal, and a second current electrode;

a second transistor of a second conductivity type having a first current electrode coupled to the second current electrode of the first transistor for providing the output current limit signal, a control electrode coupled to a second control signal for enabling the circuit, and a second current electrode;

a third transistor of the second conductivity type having a first current electrode coupled to the second current electrode of the second transistor, a control electrode coupled to the first control signal, and a second current electrode coupled to a reference voltage terminal; and a fourth transistor of the first conductivity type having a first current electrode coupled to the output terminal, a control electrode coupled to the second control signal, and a second current electrode coupled to the second current electrode of the first transistor.

3. The voltage regulator of claim 2 wherein said delay means further comprise:

a fifth transistor of the first conductivity type having a first current electrode coupled to the output terminal, a second current electrode, and a control electrode coupled to the output current limit signal of the input logic means; and a sixth transistor of the second conductivity type having a first current electrode coupled to the second current electrode of the fifth transistor for providing the delayed output current limit signal, a control electrode coupled to the output current limit signal of the input logic means, and a second current electrode coupled to the reference voltage terminal.

4. The voltage regulator of claim 3 wherein said output means further comprise:

a seventh transistor of the first conductivity type having a first current electrode coupled to the output terminal, a control electrode coupled to the output current limit signal, and a second current electrode;

an eighth transistor of the second conductivity type having a first current electrode coupled to the second current electrode of the seventh transistor, a control electrode coupled to the delayed output current limit signal, and a second current electrode; and a ninth transistor of the second conductivity type having a first current electrode coupled to the second current electrode of the eighth transistor, a control electrode coupled to the second current electrode of the seventh transistor, and a second current electrode coupled to the reference voltage terminal

5. A voltage regulator circuit for providing a regulated output voltage at an output terminal, comprising:

logic means coupled to the output terminal and having a first input for receiving an enable control signal, a second input for receiving a clock control signal of predetermined frequency, and an output for providing a current limit signal in response to both the enable control signal and the clock control signal;

delay means coupled to the output terminal and having an input coupled to the output of the logic means, and an output for providing a delayed clock control signal, said delay being related to the frequency of the clock control signal; and output means coupled to the output terminal, said output means having a first input for receiving the current limit signal and a second input for receiving the delayed clock control signal, said output means selectively sinking current from the output terminal in response to both the current limit signal and the delayed clock control signal to regulate the output voltage.

6. A circuit for regulating an output voltage provided at an output terminal, comprising:

a first transistor of a first conductivity type having a first current electrode coupled to the output terminal, a control electrode for receiving a first control clock signal of predetermined frequency, and a second current electrode for providing a current limit signal;

a second transistor of a second conductivity type having a first current electrode coupled to the second current electrode of the first transistor, a control electrode for receiving a second control signal, and a second current electrode;

a third transistor of the second conductivity type having a first current electrode coupled to the second current electrode of the second transistor, a control electrode for receiving the first control signal, and a second current electrode coupled to a reference voltage terminal;

a fourth transistor of the first conductivity type having a first current electrode coupled to the output terminal, a control electrode for receiving the second control signal, and a second current electrode coupled to the second current electrode of the first transistor;

a fifth transistor of the first conductivity type having a first current electrode coupled to the output terminal, a control electrode coupled to the second current electrode of the first transistor, and a second current electrode for providing a delayed current limit signal, said delay being related to the frequency of the first control signal;

a sixth transistor of the second conductivity type having a first electrode coupled to the second current electrode, a control electrode coupled to the control electrode of the fifth transistor, and a second current electrode coupled to the reference voltage terminal;

storage means having a first terminal coupled to the control electrodes of the fifth and sixth transistors, and a second terminal coupled to the second current electrode of the fifth transistor;

a seventh transistor of the first conductivity type having a first current electrode coupled to the output terminal, a control electrode coupled to the second current electrode of the first transistor, and a second current electrode;

an eighth transistor of the second conductivity type having a first current electrode coupled to the second current electrode of the seventh transistor, a control electrode coupled to the second current electrode of the fifth transistor, and a second current electrode; and a ninth transistor of the second conductivity type having a first current electrode coupled to the second current electrode of the eighth transistor, a control electrode coupled to the second current electrode of the seventh transistor, and a second current electrode coupled to the reference voltage terminal.

7. The circuit of claim 6 wherein said storage means comprises a capacitor.

* * * * *